US007034291B1

(12) United States Patent
Fischer et al.

(10) Patent No.: US 7,034,291 B1
(45) Date of Patent: Apr. 25, 2006

(54) MULTIMODE IONIZATION MODE SEPARATOR

(75) Inventors: Steven M. Fischer, Hayward, CA (US); Darrell L. Gourley, San Francisco, CA (US); Patricia H. Cormia, San Jose, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/971,658

(22) Filed: Oct. 22, 2004

(51) Int. Cl.
*H01J 49/04* (2006.01)

(52) U.S. Cl. ..... 250/288; 250/423 R; 250/424

(58) Field of Classification Search ..... 250/288, 250/423 R, 424
See application file for complete search history.

(56) References Cited

U.S. PATENT DOCUMENTS

| | | | | |
|---|---|---|---|---|
| 6,541,767 | B1 * | 4/2003 | Kato | 250/288 |
| 6,646,257 | B1 | 11/2003 | Fischer et al. | |
| 6,943,346 | B1 * | 9/2005 | Tan et al. | 250/288 |
| 2004/0079881 | A1 | 4/2004 | Fischer et al. | |
| 2005/0211911 | A1 * | 9/2005 | Fischer et al. | 250/423 R |

* cited by examiner

*Primary Examiner*—Kiet T. Nguyen

(57) ABSTRACT

A multimode ionization source includes an electrospray ionization source for providing a charged aerosol, an atmospheric pressure ionization source downstream from the electrospray ionization source for further ionizing said charged aerosol, and a mode separator, or mask, situated so as to separate a portion of the charged aerosol and prevent the portion from being exposed to the atmospheric pressure ionization source.

19 Claims, 6 Drawing Sheets

MULTIMODE IONIZATION MODE SEPARATOR

RELATED APPLICATIONS

The present application is related to commonly assigned and co-pending U.S. patent application Ser. No. 10/640,176, filed Aug. 13, 2003, and its parent application Ser. No. 10/245,987, filed Sep. 18, 2002 (issued as U.S. Pat. No. 6,646,257), which are both entitled "Multimode Ionization Source". Both of these applications are incorporated by reference in their entirety.

FIELD OF THE INVENTION

The invention relates generally to a method and system for separating streams of ions in a multiple mode ionization source such that ions generated using the multiple modes do not mutually interfere.

BACKGROUND INFORMATION

The advent of atmospheric pressure ionization (API) has resulted in an explosion in the use of LC/MS analysis. There are currently three main API techniques: electrospray ionization (ESI), atmospheric pressure chemical ionization (APCI) and atmospheric pressure photoionization (APPI). Each of these techniques ionizes molecules through a different mechanism, and none of the mechanisms are capable of ionizing the entire range of molecular weights and compositions that may be included in a widely varied sample.

Multiple mode ionization sources ("multimode sources") have been developed which address this difficulty by employing ESI in combination with either APCI or APPI in a single device, so that analytes that are not ionized by the ESI source may be ionized by the secondary ionization mechanism.

Example embodiments of multimode ionization sources are described in U.S. patent application Ser. No. 10/640,176 and its parent application Ser. No. 10/245,987, mentioned above. In brief, in these devices, ions and vapor generated by the ESI source ("ESI ions") are entrained by a gas and guided toward the vacuum entrance by a combination of gas dynamics and electric fields. Along the trajectory to the vacuum entrance, the ions and vapor enter a volume in which the secondary APCI or APPI source is operative. It has been found that in practice, both types of secondary sources can have a deleterious effect upon ESI ions as they move toward the vacuum entrance. In the case of APCI, it has been found that the corona current emanating from the corona needle can interfere with the movement of the ESI ions toward the vacuum entrance. While the use of a counter electrode to control the corona current can be helpful, the corona current can still be difficult to control. When APPI sources are used, in addition to photoionizing neutral analyte molecules, photons interact with the previously-created ESI ions, which can have a degrading effect upon ESI signals.

It would therefore be advantageous to provide an ionization source that protects a substantial number of ESI ions from the APCI and APPI processes and thereby ensures the quality of the detected ESI signal.

SUMMARY OF THE INVENTION

A multimode ionization source according to the present invention comprises an electrospray ionization source for providing a charged aerosol, an atmospheric pressure ionization source downstream from the electrospray ionization source for further ionizing said charged aerosol, and a mask situated so as to separate a portion of the charged aerosol and prevent the portion from being exposed to the downstream atmospheric pressure ionization source.

According to a first embodiment, the downstream multimode ionization source is an atmospheric pressure chemical ionization (APCI) source. In an alternative embodiment, the downstream atmospheric pressure ionization source is an atmospheric pressure photo-ionization (APPI) source.

There are numerous configurations and designs for the mode separator mask of the present invention. By way of example and not limitation, the mask may be oriented parallel or perpendicular to the central axis of an entrance conduit through which the generated ions are supplied to the mass spectrometer, and it may include one or more plates which may be positioned at various angles with respect to one another and to the conduit.

To aid in separating a portion of the flow of electrospray ions, the multimode source of the present invention may include more than one conduit entrance to the vacuum of the mass analyzer.

It is found that by separating at least ten percent by volume of the charged aerosol generated by the electrospray ionization source, the electrospray signal is maintained even while the secondary atmospheric pressure ionization source is operating.

DETAILED DESCRIPTION

Figure 1:
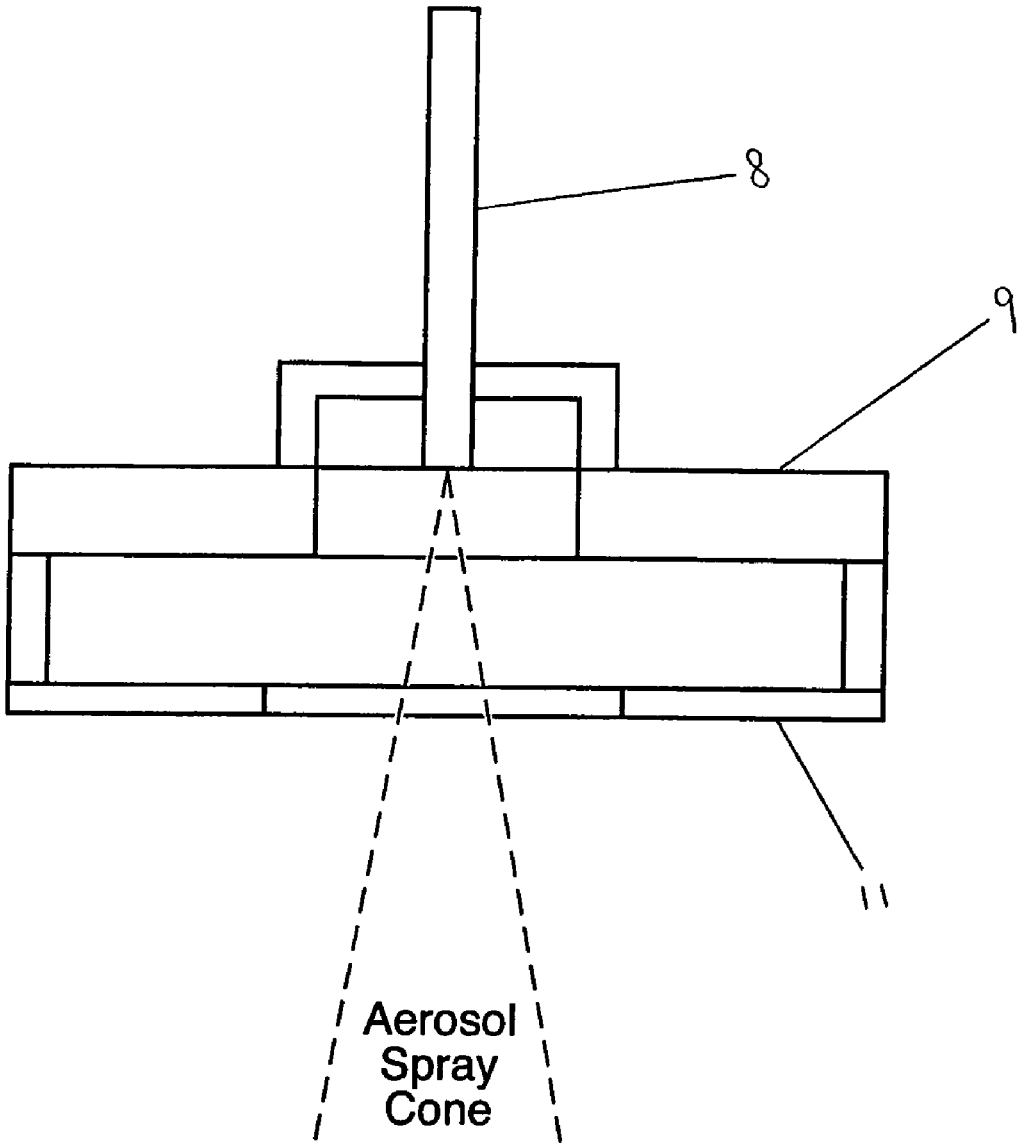
FIG. 1 shows a schematic cross sectional view of an example ESI ion source portion of a multimode source according to the present invention.

Before describing the invention in detail, it must be noted that, as used in this specification and the appended claims, the singular forms "a," "an," and "the" include plural referents unless the context clearly dictates otherwise. Thus, for example, reference to "a conduit" includes more than one "conduit". Reference to an "electrospray ionization source" or an "atmospheric pressure ionization source" includes more than one "electrospray ionization source" or "atmospheric pressure ionization source". In describing and claiming the present invention, the following terminology will be used in accordance with the definitions set out below.

The term "adjacent" means near, next to or adjoining. Something adjacent may also be in contact with another component, surround (i.e. be concentric with) the other component, be spaced from the other component or contain a portion of the other component. For instance, a "drying device" that is adjacent to a nebulizer may be spaced next to the nebulizer, may contact the nebulizer, may surround or be surrounded by the nebulizer or a portion of the nebulizer, may contain the nebulizer or be contained by the nebulizer, may adjoin the nebulizer or may be near the nebulizer.

The term "conduit" refers to any sleeve, capillary, transport device, dispenser, nozzle, hose, pipe, plate, pipette, port, orifice, orifice in a wall, connector, tube, coupling, container, housing, structure or apparatus that may be used to receive or transport ions or gas.

The term "corona needle" refers to any conduit, needle, object, or device that may be used to create a corona discharge.

The term "molecular longitudinal axis" means the theoretical axis or line that can be drawn through the region having the greatest concentration of ions in the direction of the spray. The above term has been adopted because of the relationship of the molecular longitudinal axis to the axis of the conduit. In certain cases a longitudinal axis of an ion source or electrospray nebulizer may be offset from the longitudinal axis of the conduit (the theoretical axes are orthogonal but not intersecting). The use of the term "molecular longitudinal axis" has been adopted to include those embodiments within the broad scope of the invention. To be orthogonal means to be aligned perpendicular to or at approximately a 90 degree angle. For instance, the molecular longitudinal axis may be orthogonal to the axis of a conduit. The term substantially orthogonal means 90 degrees±20 degrees. The invention, however, is not limited to those relationships and may comprise a variety of acute and obtuse angles defined between the projection of the line of the molecular longitudinal axis in a plane with the longitudinal axis of the conduit.

The term "nebulizer" refers to any device known in the art that produces small droplets or an aerosol from a liquid.

The term "ion source" or "source" refers to any source that produces analyte ions.

The term "ionization region" refers to an area between any ionization source and the conduit.

The term "electrospray ionization source" refers to a nebulizer and associated parts for producing electrospray ions. The nebulizer may or may not be at ground potential. The term should also be broadly construed to comprise an apparatus or device such as a tube with an electrode that can discharge charged particles that are similar or identical to those ions produced using electrospray ionization techniques well known in the art.

The term "atmospheric pressure ionization source" refers to the common term known in the art for producing ions. The term has further reference to ion sources that produce ions at ambient pressure. Some typical ionization sources may include, but not be limited to electrospray, APPI and APCI ion sources.

The term "detector" refers to any device, apparatus, machine, component, or system that can detect an ion. Detectors may or may not include hardware and software. In a mass spectrometer the common detector includes and/or is coupled to a mass analyzer.

According to the present invention, a multimode ion source includes a mode separator which separates a portion of the flow of analyte ions as they flow toward the conduit along the molecular longitudinal axis such that the separated portion is not exposed to the secondary ionization source, and is also not substantially affected by any aspect including, but not limited to, space charge and/or other field effects.

The multimode source comprises a primary ion source and a secondary ion source positioned downstream from the primary ion source. Both may be enclosed in a single housing. However, this is not a required element of the invention, and it is anticipated that the ion sources may be placed in separate housings or even be used in an arrangement where the ion sources are not used with a source housing at all. It should be mentioned that although the source is normally operated at atmospheric pressure (around 760 Torr), it can be maintained alternatively at pressures from about 20 to about 2000 Torr.

The primary ion source may comprise an atmospheric pressure ion source and the second ion source may also comprise one or more atmospheric pressure ion sources. According to one embodiment, the primary ion source is an electrospray ion source or similar type device that provides charged droplets and ions in an aerosol form. The electrospray ion source includes a nebulizer for producing an aerosol, which is then charged by applying a highly localized electric field ($\approx 10^8 V/cm^2$) near the tip of the nebulizer.

FIG. 1 shows a cross section of an ESI portion of a multimode ion source. As shown, the ESI ion source includes a nebulizer 8 which ejects an aerosol spray cone, a charging electrode 9 and a reversing electrode 11. In the depicted embodiment, the nebulizer 8 is at ground and a double halo electrode (with holes) is used. The first electrode 9 is the charging electrode and is typically set to −2000V. The second electrode 11 is a field reversing electrode and is set at the same voltage as the APCI chamber which is typically at ground. This design allows for ESI operation with a grounded nebulizer 8 since the field reversing electrode 11 separates the ESI field from the APCI field and permits ESI and APCI ionization to occur. In this case, when a downstream APCI source is used as the secondary ion source, the corona needle may be set at a higher (more positive) level (typically +3500V) than the entrance to the vacuum system (typically −3000V) and the APCI chamber (typically ground). For negative ions, all the voltage polarities are reversed.

Figure 2A:
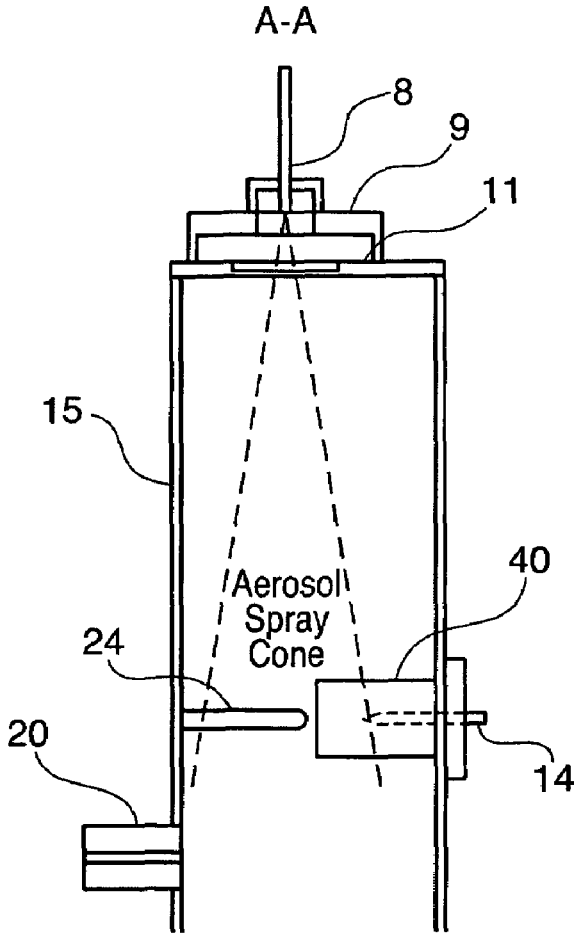
FIG. 2A shows a longitudinal cross section (along section A—A of FIG. 2B) of a first embodiment of a multimode source including a mode separator mask according to the present invention.

The nebulizer 8 has a longitudinal bore that runs from a top portion to a tip. The longitudinal bore is designed for transporting samples to the nebulizer tip for the formation of the charged aerosol that is discharged into an aerosol spray cone located within a generally enclosed space 15 (as shown in FIG. 2A). The combination of gas and liquid flow rate from the nebulizer typically ranges from 0.3 liters/minute up to 5 liters/minute, and the charged aerosol current (ESI current) typically-ranges, with some dependence on the type of solvent used, from between 0.1 and 2.0 microamperes. A drying device may be included to provide drying and/or sweep gas to the charged aerosol produced and discharged from the nebulizer tip.

According to another embodiment (not shown), the nebulizer 8 is floated above ground. A typical voltage for positive ion operation would be +3000V. A counter electrode (with a hole) may also be set near ground opposite from the exit of the nebulizer 8. The counter electrode voltage (typically ground) would need to be less positive than the voltage on the downstream APCI source needle (which typically operates near +3500V) but more positive than the entrance to the vacuum system (typically −3000V). For negative ion generation, all the voltage polarities are reversed.

Nebulizing gas pressure is used in both embodiments to propel the ESI aerosol into the APCI chamber. In the first embodiment, the gas also must overcome the retarding field gradient (between the charging electrode and reversing electrode) to push the aerosol into the APCI chamber. The advantage here is that a cheaper power supply may be used and safety is enhanced because the components are grounded. In the second embodiment, the gas does not have to push the aerosol up a field gradient so that the nebulizing gas pressure can be set at a lower level.

Figure 2B:
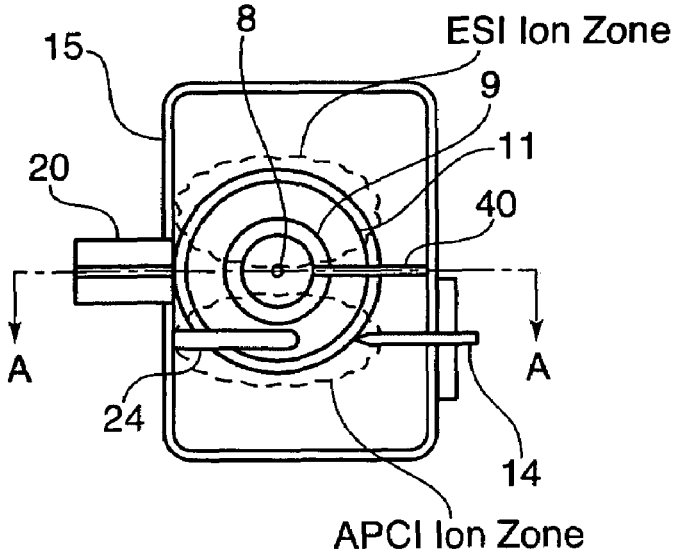
FIG. 2B shows a bottom-up view of the first embodiment of the multimode source according to the present invention.

FIG. 2A depicts a cross section of an ESI/APCI multimode source according to an embodiment of the present invention. As shown, ESI ions generated in the ESI ion source portion flow in a region generally resembling a cone ("spray cone" or "ESI ion zone") downstream toward the secondary APCI ion source. In this case, a portion of the ESI ions flow into a region where the downstream APCI source is operative (APCI ion zone). This region is depicted in FIG. 2B which shows a bottom-up view of the multimode source depicted in FIG. 2A. The APCI source includes a corona needle 14 and a counter electrode 24 for facilitating a corona current for inducing chemical ionization.

The current generated in the corona discharge in APCI sources can range from 0.5 microamperes to 40 microamperes, and typically ranges between 2 and 4 microamperes, which is larger than the ESI current. Thus, if the secondary ion source of the multimode ion source is an APCI source, the field at the nebulizer 8 is isolated as much as possible from the voltage applied to the corona needle 14 in order not to interfere with the initial ESI process. The corona needle may be substantially surrounded by a shield (not shown) having a small orifice for ejecting the corona current.

Even with the use of a corona needle shield, the corona field, space charge effects, and/or other electrical/chemical effects, such as chemical interactions of the ions in the corona current, can deleteriously affect the ESI charged aerosol current. To further isolate the ESI current from the corona current, a mode separator, or mask 40, is employed to prevent the corona current from substantially impacting the ESI current, and conversely, to provide a flow path for the ESI current that bypasses the corona region. The mask may be implemented using a metal plate, or combination of metal plates, or any other suitable material as known in the art. As is clearly indicated in FIG. 2B, the mask 40 is positioned adjacent to and in front of the corona needle 14 so as to block the corona current from having a substantial effect on the portion of the ESI current behind the mask. The stream of ESI ions ejected from the nebulizer 8 is thus split into two streams by the mask 40. In general, the mask is designed to be large enough to separate enough of the ESI stream so that the ESI signal is not decreased by more than a factor of 10 when the secondary ion source (in this case APCI) is turned on.

In the embodiment shown in FIG. 2B, the mask 40 is oriented such that the ESI ion stream is diverted in a direction perpendicular to the axis of the conduit 20 leading to the mass analyzer, and thus may be termed a 'perpendicular' embodiment of the mode separator according to the present invention.

Figure 3A:
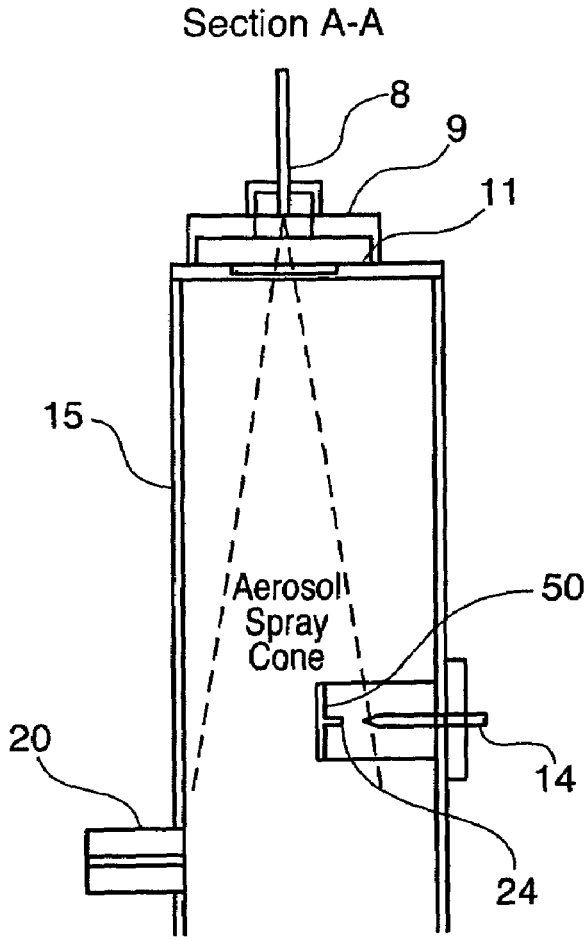
FIG. 3A shows a longitudinal cross section (along section A—A of FIG. 3B) of a second embodiment of a multimode source according to the present invention in which the mode separator mask is oriented in parallel with respect to the conduit.
Figure 3B:
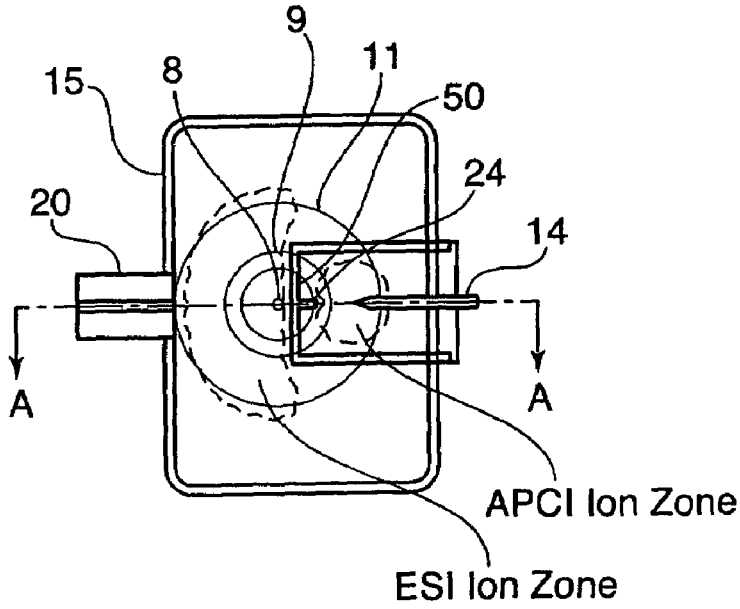
FIG. 3B shows a bottom-up view of the second embodiment of the multimode source according to the present invention.

FIGS. 3A and 3B depict a 'parallel' embodiment in which ESI ions are diverted in a direction parallel to the axis of the conduit 20. Referring to the bottom- up view shown in FIG. 3B, a mask 50 is C-shaped in contour, such that it surrounds the corona needle of the APCI ion source on three sides. A shortened counter electrode 24 is fixed to a side the mask 50 facing the corona needle 14 ("the opposing side"). ESI ions that flow downstream between the conduit 20 and the opposing side of the mask 50 are protected to a large extent from exposure to the APCI ion zone. Conversely, as can be seen in FIG. 3B, the APCI zone is largely restricted to the area circumscribed by mask 50.

Figure 4A:
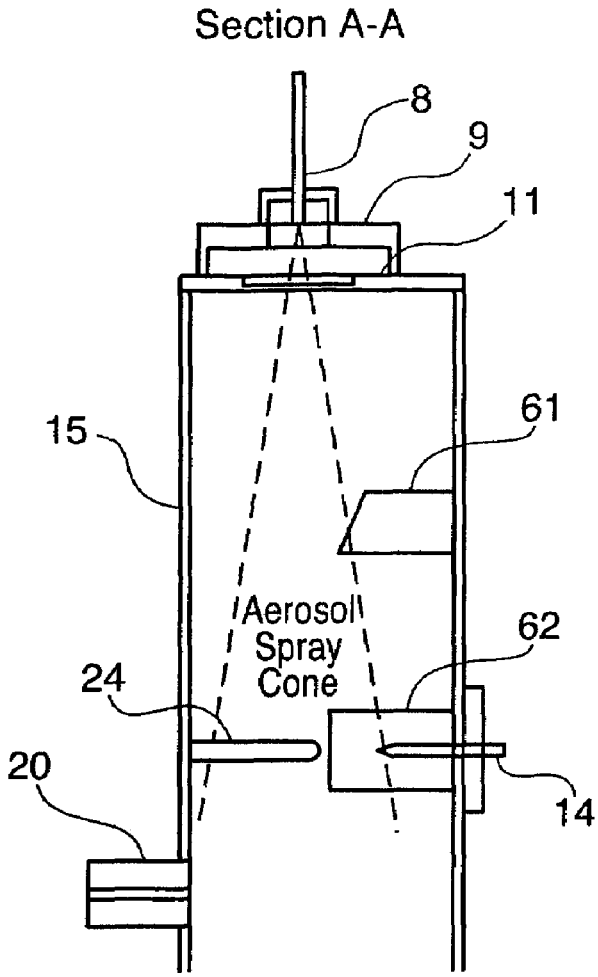
FIG. 4A shows a further embodiment of a multimode source according to the present invention including multiple mode separators.
Figure 4B:
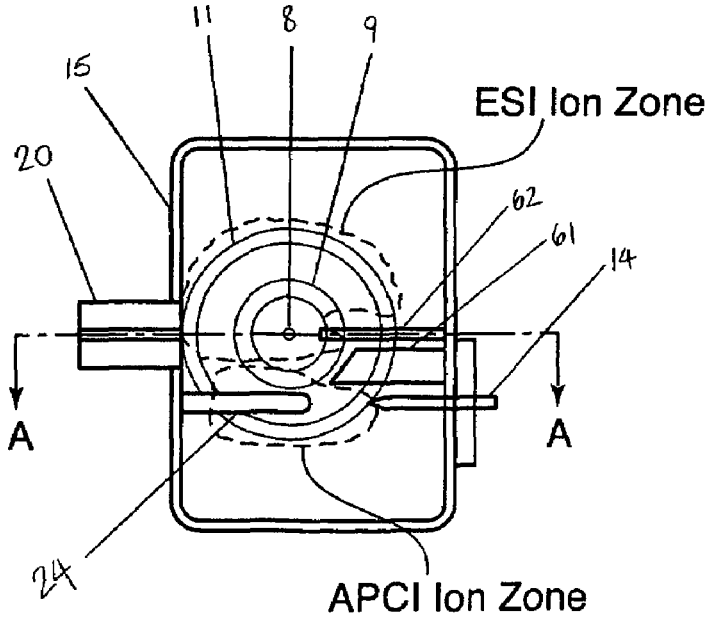
FIG. 4B shows a bottom-up view of the embodiment of the multimode source shown in FIG. 4A.

Additionally, the multimode source may include more than one mask or separator, any of which may be oriented at various angles with respect to the conduit axis. FIG. 4A illustrates an embodiment in which two masks 61, 62 are positioned within the enclosed space 15 with one mask upstream relative to the other to influence the flow of the ESI ions so as to separate a portion of the flow. As indicated in the bottom-up view of FIG. 4B, the masks 61, 62 may be offset from each other in the front or back direction. The masks may be angled (such as mask 61) or may include portions angled (at an acute or obtuse angle) with respect to the longitudinal axis of the multimode ion source to aid in directing the flow of ESI ions.

Figure 5:
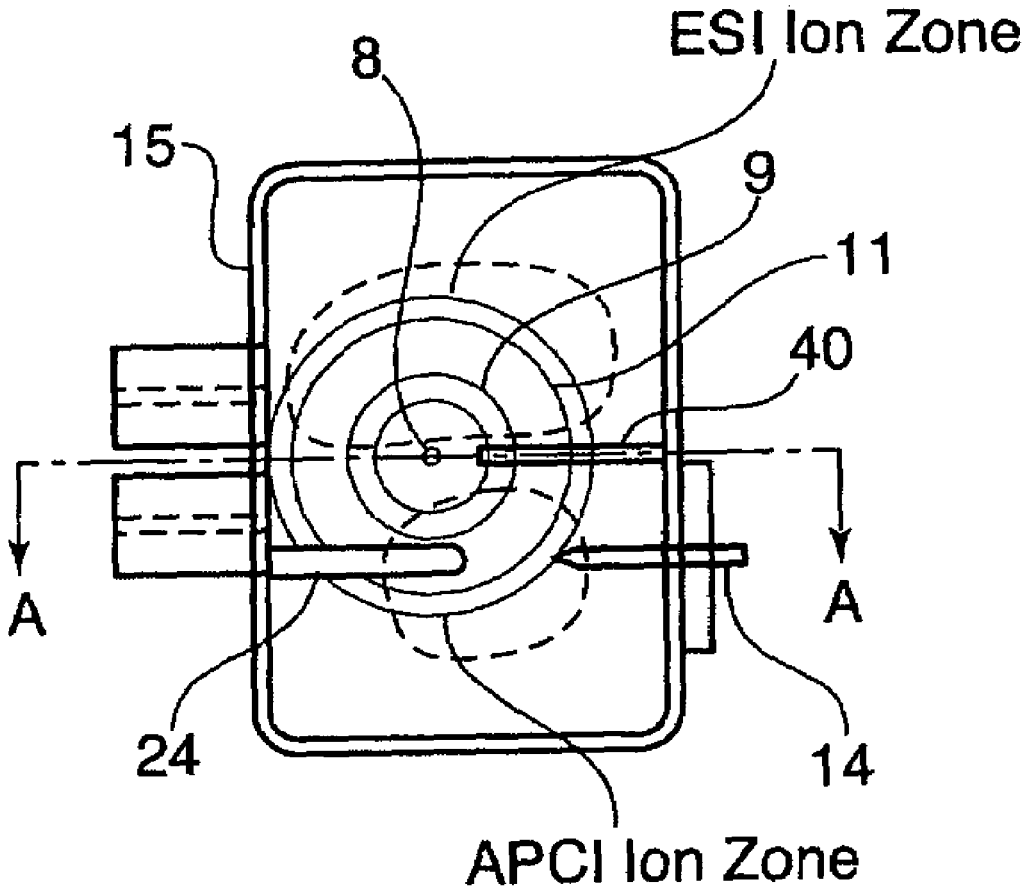
FIG. 5 shows a bottom-up view of a further embodiment of a multimode source according to the present invention including multiple conduits.

To further ensure the separation between the ESI and secondary source streams, additional conduits or vacuum entrances may be included such that a portion of the ESI stream enters a conduit without first mixing with ions generated at the secondary ion source. FIG. 5 illustrates an example embodiment in which there are two conduits 21 and 22 positioned in the enclosed space 15. In the example embodiment shown, the first and second conduits 21, 22 are positioned adjacent to each other at approximately the same longitudinal position on the ion source. Owing to the positioning and effect of the separator mask 40, the first conduit 61 is mainly exposed to the ESI ion zone, while the second conduit 62 is mainly exposed to the APCI ion zone. Due to this configuration, it is possible to detect a portion of the ESI ion stream separately and to retain the quality of its signal.

Figure 6A:
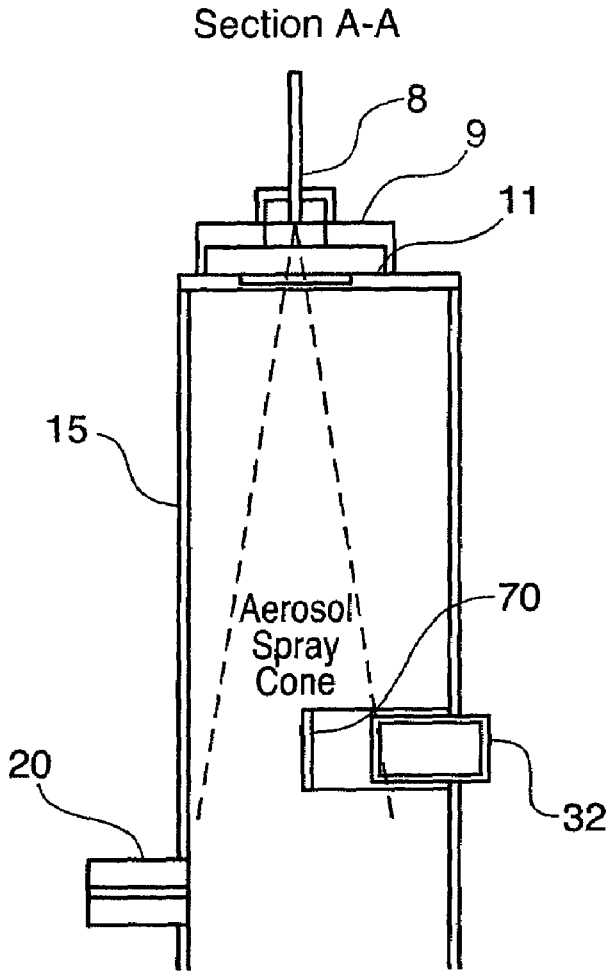
FIG. 6A shows a cross sectional view of another embodiment of a multimode source according to the present invention including an APPI secondary source.
Figure 6B:
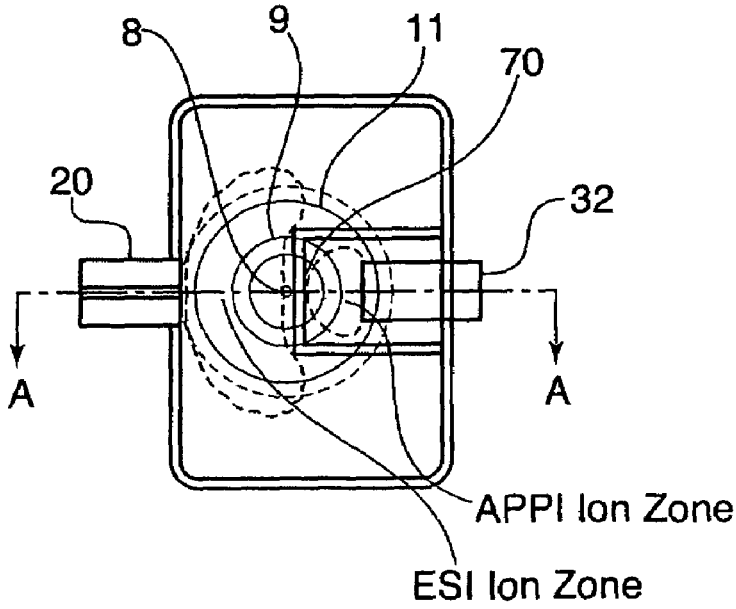
FIG. 6B shows a bottom-up view of the multimode source shown in FIG. 6A.

Use of APPI for the secondary ion source is a different situation from use of APCI since it does not require electric fields to assist in the ionization process. FIG. 6 shows a cross-sectional view of an embodiment of the invention that employs APPI with a separator mask. As shown in FIGS. 6A and 6B, the APPI source comprises an vacuum ultraviolet (VUV) lamp 32 that is interposed between the first ion source 3 and the conduit 20. The VUV lamp 32 may comprise any number of lamps that are well known in the art that are capable of ionizing molecules. A number of VUV lamps and APPI sources are known and employed in the art and may be employed with the present invention. A C-shaped mask 70 is situated within the enclosed space 15 position adjacent to and partially enclosing the VUV lamp 32 such that there is a region between the enclosed space and the mask on the side opposite to that facing the VUV lamp. As ESI ions flow downstream toward the conduit 20, a portion of the ESI ions flows behind the mask 70 and therefore is not exposed to radiation from the VUV lamp. This guarantees that a portion of the ESI ions reach the conduit without interference from the APPI source.

It is to be understood that while the invention has been described in conjunction with the specific embodiments thereof, that the foregoing description as well as the examples that follow are intended to illustrate and not limit the scope of the invention. Other aspects, advantages and modifications within the scope of the invention will be apparent to those skilled in the art to which the invention pertains.

All patents, patent applications, and publications infra and supra mentioned herein are hereby incorporated by reference in their entireties.

What is claimed is:

1. A multimode ionization source, comprising:

(a) an electrospray ionization source for providing a charged aerosol;

(b) an atmospheric pressure ionization source downstream from the electrospray ionization source for further ionizing said charged aerosol;

(c) a mask situated so as to separate a portion of the charged aerosol and prevent the portion from being exposed to the downstream atmospheric pressure ionization source; and (d) a conduit adjacent to the downstream atmospheric pressure ionization source and having an orifice for receiving ions from the charged aerosol, the conduit having a central axis.

2. The multimode ionization source of claim 1, wherein the atmospheric pressure ionization source is an atmospheric pressure chemical ionization (APCI) source.

3. The multimode ionization source of claim 1, wherein the atmospheric pressure ionization source is an atmospheric pressure photo-ionization (APPI) source.

4. The multimode ionization source of claim 1, wherein the mask is oriented parallel to the central axis of the conduit.

5. The multimode ionization source of claim 1, wherein the mask is oriented perpendicular to the central axis of the conduit.

6. The multimode ionization source of claim 1, wherein the mask includes a plurality of separators.

7. The multimode ionization source of claim 1, wherein the mask is oriented at an angle with respect to the central axis of the conduit.

8. The multimode ionization source of claim 1, further comprising:

a second conduit;

wherein the second conduit is disposed so as to receive only the separated portion of charged aerosol.

9. The multimode ionization source of claim 1, wherein the mask includes at least one metal plate.

10. The multimode ionization source of claim 1, wherein the portion of the charged aerosol includes at least ten (10) percent by volume of the charged aerosol generated by the electrospray ionization source.

11. A method of generating ionized analyte molecules comprising:

subjecting the analyte molecules to electrospray ionization thereby creating a charged aerosol;

separating the charged aerosol into a first flow and a second flow;

subjecting the first flow of charged aerosol to a secondary process of atmospheric pressure ionization to further ionize said charged aerosol;

protecting the second flow from exposure to the secondary process of atmospheric pressure ionization; and receiving at least the first flow in a conduit having a central axis.

12. The method of claim 11, wherein the secondary process of atmospheric pressure ionization constitutes atmospheric pressure chemical ionization (APCI).

13. The method of claim 11, wherein the secondary process of atmospheric pressure ionization constitutes atmospheric pressure photo-ionization (APPI).

14. The method of claim 11, wherein the charged aerosol is separated using a mask.

15. The method of claim 14, wherein the mask is oriented parallel to the central orifice of the conduit.

16. The method of claim 14, wherein the mask is oriented perpendicular to the central orifice of the conduit.

17. The method of claim 14, wherein the mask is oriented at an angle with respect to the central axis of the conduit.

18. The method of claim 11, further comprising:

receiving the second flow in the conduit.

19. The method of claim 11, further comprising:

receiving the second flow in a second conduit.

* * * * *